United States Patent [19]

Zimmermann et al.

[11] 3,973,902

[45] Aug. 10, 1976

[54] PROCESS AND DEVICE FOR THE CONTINUOUS FIXATION OF PRINTS AND PAD-DYEINGS ON POLYESTER FIBERS AND THEIR MIXTURES WITH CELLULOSE FIBERS

[75] Inventors: Hans Zimmermann, Hofheim, Taunus; Heinrich Thumm, Frankfurt am Main; Kurt Roth, Hofheim, Taunus, all of Germany

[73] Assignee: Hoechst Aktiengesellschaft, Frankfurt am Main, Germany

[22] Filed: Oct. 4, 1973

[21] Appl. No.: 403,649

[30] Foreign Application Priority Data

Oct. 7, 1972 Germany ..... 2249330

[52] U.S. Cl. ..... 8/21 C; 8/165; 8/173

[51] Int. Cl.[2] ..... D06P 1/82

[58] Field of Search ..... 8/165, 172, 173, 175

[56] References Cited

UNITED STATES PATENTS

| | | | |
|---|---|---|---|
| 2,184,559 | 12/1939 | Mellar | 8/173 |
| 2,273,305 | 2/1942 | Whitehead | 8/14 |
| 2,511,103 | 6/1950 | Croft | 8/173 |
| 3,255,173 | 6/1966 | Dehnert | 8/173 |
| 3,512,913 | 5/1970 | Day et al. | 8/173 |
| 3,744,967 | 7/1973 | Thachrah | 8/173 |

OTHER PUBLICATIONS

Meier–Windhorst, Amer. Dyestuff Rep. Jan. 1970, pp. 28–33.

*Primary Examiner*—Donald Levy
*Attorney, Agent, or Firm*—Curtis, Morris & Safford

[57] ABSTRACT

Process for the continuous fixation of prints and pad-dyeings on polyester fibers and mixtures of polyester and cellulose fibers, wherein the carriers usual for the fixation of the disperse dyestuffs, are sprayed onto the fiber material, at a liquor pick-up of 5 to 50%, immediately before the fixation of the dyestuff.

1 Claim, 2 Drawing Figures

Figure 1:
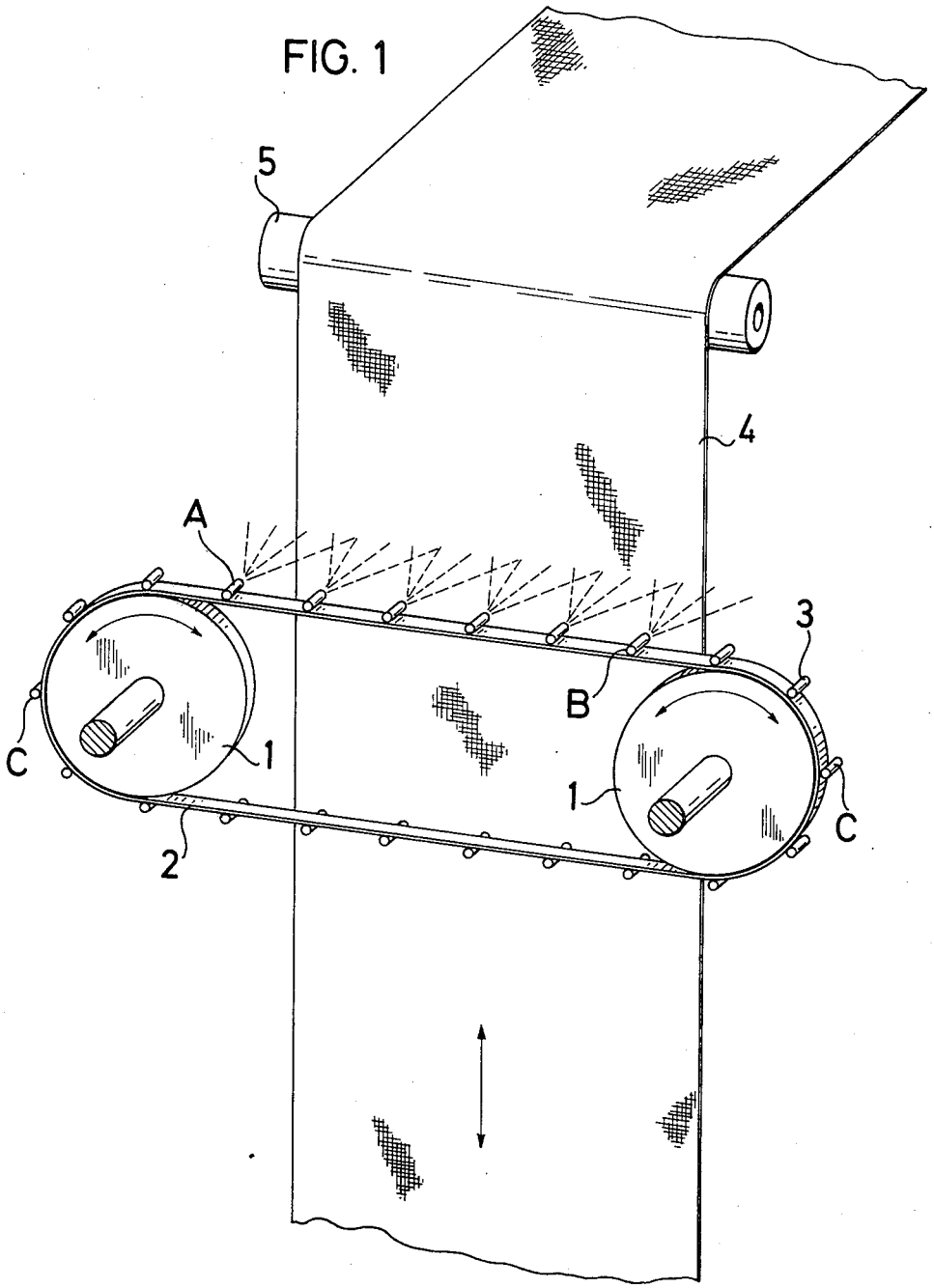

PROCESS AND DEVICE FOR THE CONTINUOUS FIXATION OF PRINTS AND PAD-DYEINGS ON POLYESTER FIBERS AND THEIR MIXTURES WITH CELLULOSE FIBERS

In the continuous fixation of disperse dyestuffs on polyesters and mixtures of polyester and cellulose fibres, either hot air of 170° to 220°C or overheated steam at temperatures of from 140° to 190°C is used. In all cases it has proved to be suitable to add certain agents that assist fixation, the so-called carriers, which ensure a better fixation of the dyestuff.

In addition to the carriers on the basis of hydroxydiphenyl, methyl naphthalene, benzoic acid or salicyclic acid alkyl esters or oxethylation products of alkyl phenols, there may be generally used as fixation auxiliaries all surface-active esterification products of carboxylic acids with higher-molecular polyglycols usually employed for synthetic fibres as they are described for example in German Auslegeschrift No. 1 138 735; furthermore, alkylation products of fatty acids, fatty acid monoesters or fatty amines according to German Patent Specification No. 1 184 730, in the case of which fatty acids are condensed in the molar ratio of 1:1 with butane-diol-(1,4)-pentaglycolic ethers can be used for this purpose.

However, these carriers, a large part of which has hitherto been used for practical grounds only as fixation auxiliaries for dyeings, and which have proved to be unsuitable for textile printing, have some disadvantages. Whereas the first-mentioned products, having an excellent carrier effect, dull the shade more or less, since they can be with difficult and incompletely washed out from the fibre material, affecting, thus, in general, the fastnesses to light of the prints, the last-mentioned products which do not have these disadvantages, have generally no sufficient carrier effect.

In order to overcome these disadvantages, carriers have already been proposed which consist of mixtures of oxethylated β-naphthol and long-chained alkane- or alkene-monocarboxylic acid esters of butane-diol-(1,4)-polyglycol ethers, whereby these carrier-mixtures can additionally contain oxethylated ricinol acids and alkylene-benzene-sulfonates.

These compounds show indeed an improved carrier effect but they have the disadvantage that they change the fine division of the disperse dyestuffs when used in the printing paste. The result is a rather intense abrasion of the prints before the fixation of the dyestuff, and due to the so-called "blotting paper effect", a soiling of the non-printed fibre surface, furthermore, a bleeding of the prints, if they are stored for some time before fixation as well as a deposit of steam volatile constituents in the drying loft of the printing machines.

It has now been found that these disadvantages can be avoided by adding the carriers no longer to the printing paste but by spraying them in a continuous working process onto the material immediately before the fixation of the dyestuff.

In this process the polyester of polyester/cellulose material is at first printed or padded in the usual manner and with addition of the usual auxiliaries with disperse dyestuffs, individually or in mixture with reactive dyestuffs and subsequently dried. The dried material is then sprayed in a suitable device with an aqueous dispersion or solution of the carrier, whereby the liquor pick-up is to be 5 to 50 %, preferably 10 to 30 %. Then the dyestuff is fixed with overheated steam at temperatures of from 140° to 190°C with hot air of 170° to 220°C or by saturated steam at 100°–110°C. Fixation can be effected not only in special two phase devices, such as for example in turret, lightening, arch or Krostewitz steamers, but also in conventional steaming devices, such as for example Mather-Platt-, loop-, sieve drum-, wire-cloth steamers and other devices. The construction principle of these plants is represented graphically in Melliand Textilberichte, 45 (1964), pages 179 – 180 or Textilpraxis, 23 (1968), pages 754 and 758.

As alkalis for fixing the reactive dyestuffs are used caustic soda, sodium or potassium carbonate or bicarbonate, substances splitting off alkalis and water glass, individually or in mixture, if desired, with addition of a sequestration agent.

As materials to be printed or dyed may be considered textiles such as, for example, woven fabrics, knitted fabrics, fibre fleeces and the like, which consist of high-molecular, linear polyesters or the mixtures thereof with natural or regenerated cellulose materials.

As dyestuffs are preferably used the products usually known under the term "disperse dyestuffs", for example of the azo or anthraquinone dyestuff type end of the quinophthalone type as well as the known reactive dyestuffs.

In the case of fibre materials of pure polyester, substances can be sprayed on simultaneously with the carriers, which avoid or reduce the hardening of the thickening agent film on the surface during fixation and facilitate considerably the washing-out of the prints.

If mixed fabrics of polyester and cellulose fibres are printed, the fabric is sprayed after fixing the disperse dyestuff with an aqueous solution containing the alkali required for fixing the reactive dyestuff, and subsequently fixed in the manner usual for this type of dyestuff. Instead of with two separated spraying processes the alkali can also be sprayed simultaneously with the carrier. At the same time an after-treating agent can also be sprayed, if required.

Figure 2:
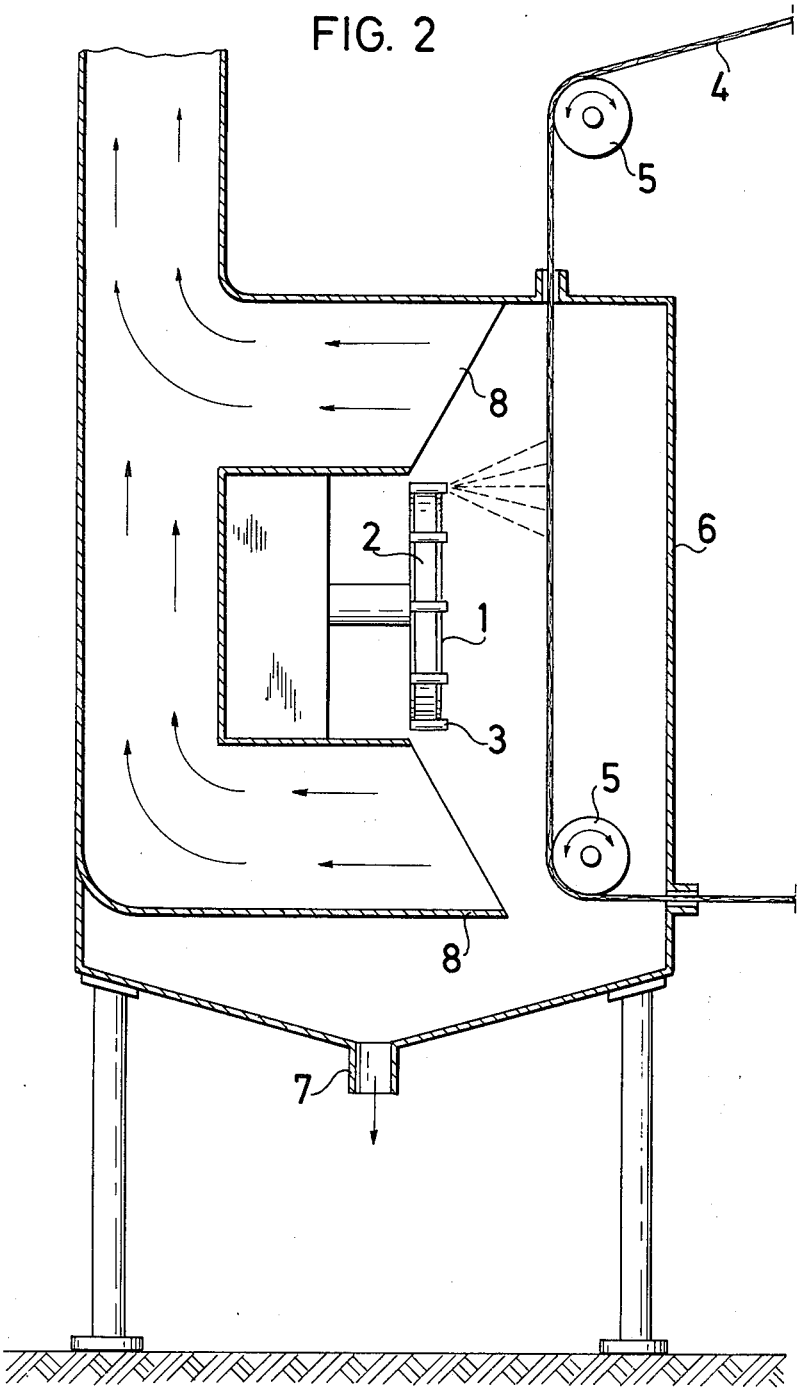

A suitable device for carrying out the process is represented in the FIGS. 1 and 2. It essentially consists of two driving pulleys 1 carrying an endless belt 2 in circulation, on which about 15 to 50 spraying nozzles 3 of the usual type are attached. The material to be sprayed 4 is conducted over guide pulleys 5 in an about 40 to 80 cm distance past the rotating nozzles. These nozzles are supplied with the spraying liquid required over a centrally mounted distributor head from a storage vessel. The nozzles are attached in such a way as to permit them to be switched on and off by compressed air. When the device is in action, the nozzles are switched on and off in each case at the points A and B, according to the direction of rotation. If it should be necessary to exchange a nozzle for blocking or for other reasons, the circulating belt can be stopped without interrupting the spraying process and the nozzle concerned can be exchanged at the points C. The whole spraying device including the part of the material web to be sprayed is closed in by a chamber 6. A collecting and outlet device 7 for the spray which forms a deposit is placed at the bottom. Since spraying implies a certain impact pressure onto the material, this pressure is compensated with a discharge device 8 placed close to the rotating belt. This device also removes by suction the portion in excess of the spray which has not been absorbed by the material.

The following Examples illustrate the process of the invention. Parts and percentages are by weight unless stated otherwise.

EXAMPLE 1

40 Grams of the powdery disperse dyestuff of the formula

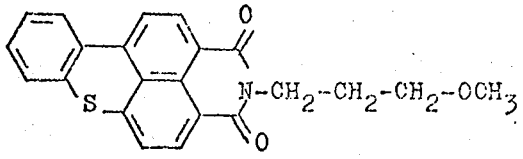

corresponding to Colour Index No. 71,272, were at first stirred to a paste with 100 g of cold water and then dispersed with 325 g of hot water and introduced, while stirring, through a sieve into 550 g of thickening which consists of a mixture of equal parts of a 25 % crystal gum thickening and a 10 % aqueous solution of a starch ether. Then 25 g of an aqueous solution of 8 g of the sodium salt of m-nitrobenzenesulfonic acid and 2 g of monosodium-phosphate were added.

A knitted fabric of texturized polyethylene-terephthalate fibres was printed with the printing ink described above, dried and sprayed with a 10 % aqueous emulsion of o-phenyl-phenol and an emulsifier, at a liquor pick-up of 30 %. Subsequently the material was steamed for 8 minutes at 180°C in a loop steamer and worked up as usual.

A brilliant yellow print having excellent fastness properties was obtained with a very good color yield.

EXAMPLE 2

30 Grams of the disperse dyestuff of the formula

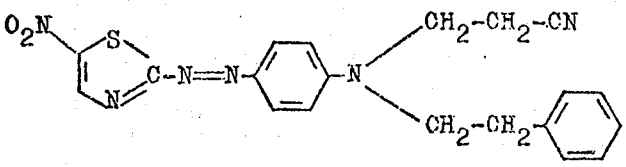

in the usual commercial form and standardization, and 5 g of monosodium phosphate were dispersed or dissolved in 965 g of water and padded on a three-roller foulard, with a liquor pick-up of 80 %, onto a fabric of polyester staple fibres and dried. The material was subsequently sprayed with 50 g of a mixture consisting of 20 g of butane-diol-(1,4)-pentaglycolether-monostearic acid ester and 30 g of an addition product of 4 mols of ethylene oxide with 1 mol of β-naphthol, dissolved with 950 g of water, with a liquor pick-up of 10 %, then the material was fixed for 40 seconds on a stenter at 185°C and after-treated as usual.

A brilliant violet dyeing having an excellent color yield and good fastness properties was obtained.

EXAMPLE 3

40 Grams of the disperse dyestuff of the formula

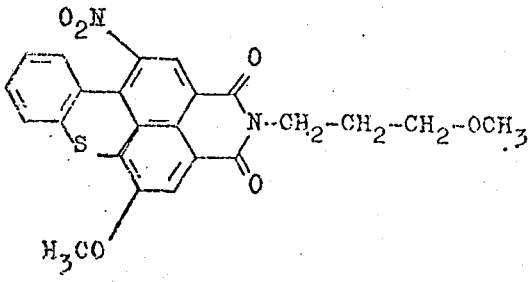

as disclosed in German Pat. No. 1,569,737, in a commercial form and standardization were first stirred to a paste with 100 g of cold water and then dispersed with 335 g of boiling water and introduced, while stirring, through a sieve, into 500 g of an aqueous thickening consisting of a mixture of equal parts by weight of a 25 % crystal gum thickening and a 10 % aqueous solution of the esterification product of polyglycol (molecular weight of 2000) and stearic acid. Then 25 g of an aqueous solution of 8 g of the sodium salt of m-nitrobenzene-sulfonic acid and 2 g of monosodiumphosphate were added.

An endless fabric of polyethylene terephthalate fibres was printed with the printing ink described above, dried and, with a liquor pick-up of 20 %, sprayed with 80 g of a mixture of equal parts of butane-diol-(1,4)-pentaglycolether-monopalmitic acid ester and of the addition product of 4 mols of ethylene oxide with 1 mol of β-naphthol in 920 g of water. The fabric was steamed for 4 minutes at 180°C in a high temperature steamer and after-treated as usual.

A pink print having good fastness to wetting and to light was obtained.

EXAMPLE 4

80 Grams of disperse dyestuff of the formula

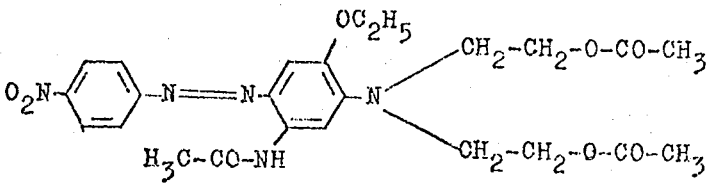

as disclosed in German Pat. No. 1,224,857, in the commerical form and standardization were dispersed with 420 g of cold water and introduced, while stirring, through a sieve, into 500 g of thickening, which consisted of 3 parts of a 10 % aqueous alginate thickening and 2 parts of a 10 % aqueous starch ether.

A fabric of polyester staple fibres was printed with this printing ink and dried.

The fabric was sprayed with a solution of 120 g of a mixture consisting of 2 parts of butane-diol-(1,4)-pentadecaglycol ether-dioleyl ester, 1 part of the addition product of 2 mols of ethylene oxide with 1 mol of β-naphthol and 1 part of the addition product of 36 mols of ethylene oxide with castor oil, in 880 g of water, the liquor pick-up being 10 %, fixed for 1 minute at 200°C in a stenter and after-treated as usual. A navy-blue print which could be washed out easily, having good fastnesses to use and to light was obtained.

EXAMPLE 5

A mixture of 24 g of the disperse dyestuff of the formula

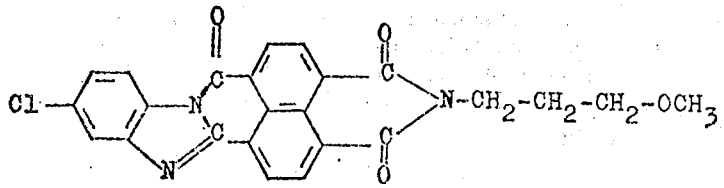

as disclosed in German Pat. No. 2,246,110, and 16 g of the reactive dyestuff of the formula

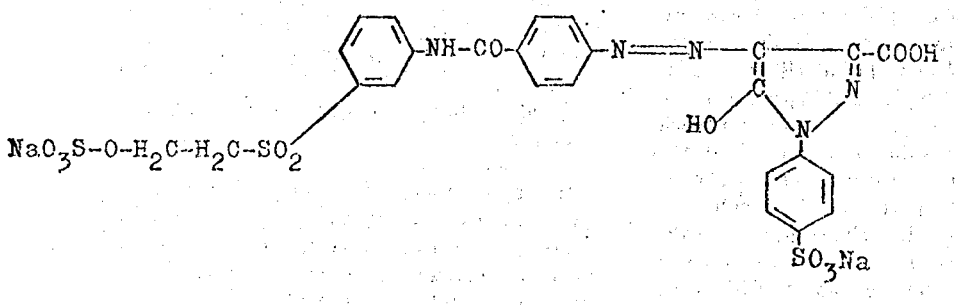

as disclosed in German Pat. No. 965,902, were first dispersed or dissolved with 448 g of water heated to 80°–90°C and then introduced into 350 g of a 10 % alginate thickening and 50 g of a 10 % solution of the addition compound of polyglycol 2000 with stearic acid were added. Subsequently 100 of heavy petrol were introduced by emulsifying and 2 g of monosodium phosphate and 10 g of the sodium salt of m-nitrobenzene-sulfonic acid were added.

A bleached mercerized knitted fabric of polyester/cotton 67:33, was printed with this printing ink, dried and sprayed with 40 g of a mixture which consisted of 2 parts of butanediol-(1,4)-pentadecaglycol ether-dioleyl ester, 1 part of the addition product of 2 mols of ethylene oxide with 1 mol of β-naphthol and 1 part of the addition product of 36 mols of ethylene oxide with castor oil, 20 g of sodium carbonate and 940 g of water, at a liquor pick-up of 20 %. Then the material was steamed continuously for 5 minutes at 180°C in a high temperature steamer and worked up as usual.

A clear yellow print with a good color build-up and an excellent harmonizing of the shades on both fibre materials was obtained.

EXAMPLE 6

A bleached causterized mixed fabric of polyester/spun rayon 65:35 was printed with the printing paste mentioned in Example 5 and dried. Then, for fixing the disperse dyestuff, the fabric was sprayed with 80 g of a mixture of equal parts of the addition product of 2 mols of ethylene oxide with 1 mol of β-naphthol and butanediol-(1,4)-pentadecaglycolether-dioleyl ester in 920 g of water, at a liquor pick-up of 20 %, and steamed for 5 minutes at 180°C in a high temperature steamer. Subsequently it was sprayed again at a liquor pick-up of 20 % with a solution of 10 g of sodium carbonate and 5 g of polyphosphate in 985 g of water, steamed for 5 minutes in the Mather steamer for fixing the dyestuff and after-treated as usual.

EXAMPLE 7

50 Grams of the dyestuff mixture of 28.6 parts of 1-amino-4-oxy-2-(6′-oxy-n-hexyl-oxy)-anthraquinone, 28.6 parts of the dyestuff having the following constitution

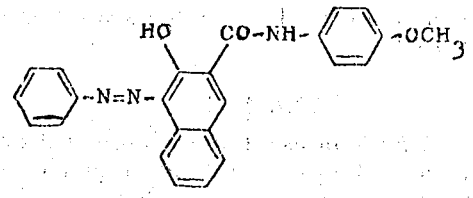

as disclosed in German Pat. No. 1,131,639, 34.3 parts of the dyestuff formed by coupling the diazotized 1-aminobenzene-4-β-oxyethyl-sulfone-sulfuric acid ester with 8-acetylamino-1-naphthol-3,6-disulfonic acid and 8.5 parts of the dyestuff formed by coupling the diazotized 2-aminoanisol-4-β-oxyethylsulfuric acid ester with 8-acetylamino-1-naphthol-3,6-disulfonic acid were dispersed or dissolved in 950 g of hot water and after cooling the bath, padded at 30°–40°C on a three-roller foulard with a liquor pick-up of 80 % onto a fabric of bleached and causterized polyester/spun rayon 50:50 and dried. At a liquor pick-up of 20 % the fabric was sprayed with a solution of 100 g of a mixture consisting of 3 parts of butane-diol-(1,4)-pentadecaglycol ether-dioleyl ester, 1 part of the addition product of 3 mols of ethylene oxide with 1 mol of β-naphthol and 1 part of the addition product of 36 mols of ethylene oxide with caster oil, with 450 g of water glass, 40° Be, 20 g of sodium hydroxide solution, 38° Be, 430 g of water, steamed for 5 minutes at 180°C in a high-temperature steamer and after-treated as usual.

A bright scarlet color having good fastness properties was obtained.

EXAMPLE 8

80 Grams of the dyestuff mixture of 55 parts of 1,4-diamino-2,3-diphenoxy-anthraquinone and 45 parts of the dyestuff formed by coupling the diazotized 1-aminobenzene-4-β-oxyethyl-sulfone-sulfuric acid ester with 8-acetylamino-1-naphthol-3,6-disulfonic acid and by converting into the copper complex were dispersed or dissolved in 420 g of water of 80 to 90°C and introduced, while stirring, into 500 g of the following stock thickening.

Stock thickening 400 g of aqueous 10 % alginate thickening
260 g of aqueous 10 % locust bean flour ether thickening 4 g of monosodium phosphate
126 g of cold water
50 g of an aqueous 10 % solution of the addition product of polyglycol 2000 stearic acid
10 g of sodium of m-nitrobenzene-sulfonic acid
150 g of heavy petrol A bleached mercerized mixed fabric of polyester/cotton 65:35 was printed with this printing paste and dried. Then, at a liquor pick-up of 15 %, the material was sprayed with a solution of 40 g of a mixture consisting of 2 parts of a twice oxethylated β-naphthol, 1 part of butane-diol-(1,4)-pentaglycol ether-monostearic acid ester and 1 part of the addition product of 32 mols of ethylene oxide with 1 mol of castor oil, 15 g of sodium bicarbonate and 945 g of water; a mechanical stirrer was placed, if desired, into the solution in order to avoid a deposit of chemical products. Subsequently, the material was fixed for 60 seconds at 200°C on a stenter and after-treated as usual.

A flowery violet print having good fastness properties was obtained.

EXAMPLE 9

A mixed fabric of bleached causterized polyester/-spun rayon (65:35) was printed with the printing paste described in Example 8 and dried. Then the fabric was sprayed, for fixing the disperse dyestuff, at a liquor pick-up of 20 %, with a 10 % aqueous emulsion of salicylic acid ethyl ester and steamed for 5 minutes at 180°C.

To fix the reactive dyestuff the material was sprayed again, at a liquor pick-up of 20 %, with a 2 % aqueous solution of sodium hydroxide 38° Be, steamed for 50 seconds in a Krostewitz steamer and worked up as usual.

EXAMPLE 10

With the dyestuff mixture indicated in Example 5 a bleached mercerized mixed fabric cotton/polyester 67:33 was printed, dried, and sprayed with the 15 % aqueous solution of butanediol-(1,4)-pentadecaglycolether-dioleyl ester at a liquor pick-up of 25 %.

Then the material was steamed continuously for 5 minutes at 180°C in a high temperature steamer and worked up as usual.

A clear yellow print with a good white bottom was obtained.

We claim:

1. In a process for the fixation of prints and pad-dyeings with disperse dyestuffs on material of polyester fibers or mixtures of polyester and cellulose fibers with carriers consisting essentially of mixtures of polyethyleneglycol ether of β-naphthol and long-chain alkane or alkene-monocarboxylic acid esters of butanediol-(1,4)-polyglycol ethers, the improvement comprising:

spraying an aqueous solution or dispersion of said carrier onto the dried, printed or padded fiber material at a liquor pick-up of 5 to 50% and immediately thereafter fixing the dyestuffs.

* * * * *